US012303009B2

(12) United States Patent
Jouan et al.

(10) Patent No.: US 12,303,009 B2
(45) Date of Patent: May 20, 2025

(54) WIPING DEVICE FOR COSMETIC PRODUCT APPLICATOR

(71) Applicant: QUALIPAC, Clichy (FR)

(72) Inventors: Frédéric Jouan, Moriers (FR); Alim El Hassain, Saint Ouen (FR)

(73) Assignee: QUALIPAC, Clichy (FR)

( * ) Notice: Subject to any disclaimer, the term of this patent is extended or adjusted under 35 U.S.C. 154(b) by 322 days.

(21) Appl. No.: 17/944,785

(22) Filed: Sep. 14, 2022

(65) Prior Publication Data

US 2023/0078841 A1 Mar. 16, 2023

(30) Foreign Application Priority Data

Sep. 16, 2021 (FR) ..... 2109753

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/046; A45D 40/267; A45D 40/268; A45D 34/047; A45D 34/045; A45D 40/265
USPC ..... 401/121, 122
See application file for complete search history.

(56) References Cited

U.S. PATENT DOCUMENTS 5,873,669 A * 2/1999 Poore ..... A45D 34/046 401/122
7,278,798 B1 10/2007 Kearney
2017/0311699 A1 11/2017 Manici
2020/0187625 A1* 6/2020 Toussaint ..... A45D 40/265

FOREIGN PATENT DOCUMENTS

FR 3 089 768 6/2020
WO 2020/127777 6/2020

OTHER PUBLICATIONS

Search Report and Written Opinion for FR 2109753 dated May 25, 2022, 14 pages.

* cited by examiner

*Primary Examiner* — David J Walczak
(74) *Attorney, Agent, or Firm* — NIXON & VANDERHYE

(57) ABSTRACT

A wiping device for a product applicator includes a first part forming a support and a second part formed as a wiping sleeve. The wiping sleeve includes a root portion connected to the first part, a wiping lip, and an intermediate portion interposed between the root portion and the wiping lip. The wiping sleeve has a half-section which has the following profile at rest: a radially inner line; a scraping tip; a front end line; a radially outer line; and a drip line defining a drip edge. The half-section is configured such that its width E increases from the intermediate portion to the scraping tip, and such that, at the scraping tip, the radially inner line forms an acute angle with the front end line.

16 Claims, 9 Drawing Sheets

WIPING DEVICE FOR COSMETIC PRODUCT APPLICATOR

CROSS-REFERENCE TO RELATED APPLICATONS

This application claims priority to FR 2109753 filed Sep. 16, 2021, the entire contents of which is hereby incorporated by reference.

BACKGROUND OF THE INVENTION

Field of the Invention

The invention relates to the field of wiping devices for product applicators, in particular cosmetic product applicators, in particular for liquid or pasty products.

Description of the Related Art

A liquid or pasty product, for example intended to be applied to a user's skin, is contained in a container, and an applicator is used to collect product from the container and then apply it to the skin or to any element, after which the applicator is reinserted into the container.

On the one hand, it is necessary to prevent the applicator from carrying too much product, and consequently a wiping device is generally provided for removing excess product that the applicator head and/or applicator stem may be carrying. On the other hand, it is also necessary to avoid the splattering that could be generated by a piston effect when inserting the applicator into or removing it from the container.

Furthermore, the viscosity of the product depends on the temperature of the product.

The withdrawal speed and insertion speed are also highly variable from one use to another or depending on the different users.

In document FR3089768, the Applicant proposed a wiping device of the above type. However, the inventors have identified a need to further improve this type of wiping device, in particular at the wiping lip itself.

SUMMARY OF THE INVENTION

A wiping device for a product applicator is thus proposed, the device having an axis A and comprising:

a first part forming a support (1), a second part formed as a wiping sleeve (2), the wiping sleeve being suitable for wiping an applicator (3) stem immersed in a product to be dispensed by means of the applicator, the first part forming a support comprising an annular base configured to rest on a mouth of a product container (9), with an axial support flange and a tubular portion (14) centered on the axis A and intended to be mounted radially inside the mouth, the wiping sleeve comprising a root portion (12) connected to the first part, a wiping lip (15), and an intermediate portion (13) interposed between the root portion and the wiping lip, the wiping sleeve comprising a central passage (20), wherein the wiping sleeve is generally a shape of revolution around the axis A with a half-section which has the following profile at rest:

a radially inner line (LRI), which gradually approaches the axis as one moves away from the root portion, a scraping tip (P4), situated at the location closest to the axis of the wiping lip, a front end line (LAV), extending radially outwards from the scraping tip, a radially outer line (LRE), which gradually approaches the axis as one moves away from the root portion, doing so at least from the root portion to the intermediate portion (13), a drip line (LEG) defining a drip edge (18), connected to the front end line and to the radially outer line, the half-section being such that its width E, measured perpendicularly to the axis, increases from the intermediate portion to the scraping tip (P4).

Whereby, such a half-section profile results in having a thickening of the lip. Such thickening of the lip provides sufficient rigidity and improves the service life of the wiping device. The thickening of the lip provides substantial clamping tension on the applicator stem and applicator head. The wiping result proves to be satisfactory for a whole range of cosmetic product viscosities and for a whole range of temperatures, as well as for a whole range of stem extraction speeds.

However, the intermediate portion provides a certain flexibility, in order to accept a slight misalignment of the applicator.

Note that the width of the half-section may be constant or may decrease from the root portion to the intermediate portion.

One will note that the product or compound contained in the container may be a liquid or pasty cosmetic product. It is also not excluded to apply the wiping device disclosed herein to pharmaceutical or medical products.

According to one particular feature, the half-section is such that, at the scraping tip, the radially inner line (LRI) forms an acute angle (β) with the front end line (LAV).

Thus, the acute angle at the scraping tip makes it possible to ensure very efficient scraping, with no residual trace along the stem. A good outward sweeping of the cosmetic product is thus observed.

In various embodiments of the invention, it is also possible to resort to one or more of the following arrangements, alone or combined.

According to one option, the width E3 of the half-section, measured perpendicularly to the axis at the scraping tip (P4), relative to the minimum width E2 measured at the intermediate portion, is such that $E3>1.3\times E2$, preferably $E3>1.4\times E2$, and more preferably $E3>1.5\times E2$.

As a result, there is a substantial thickening of the lip in the vicinity of the scraping tip, which allows good resistance of the wiping sleeve over time and good scraping pressure for a wide range of temperatures and viscosities.

According to one option, the width E3 remains less than two times E2, i.e. $E3<2\times E2$.

According to one option, the width E of the half-section may decrease from the root portion to the intermediate portion, thus forming a thinner intermediate portion. We then have a "waist" effect. This allows a slight misalignment of the applicator stem, and provides flexibility for insertion and withdrawal of the applicator by the user.

According to one option, the radially outer line (LRE) gradually moves away from the axis as one moves away from the intermediate portion towards the front end line. This partly contributes to the thickening of the wiping lip. In other words, the half-section profile diverges from the intermediate portion in a downwards direction; the radially inner line (LRI) gradually approaches the axis while conversely the radially outer line (LRE) gradually moves away from the axis.

According to one option, the drip edge may form a skirt (18) extending as a distal ring (directed downwards) relative to the root portion. It is thus possible to improve the distancing of the liquid which falls radially externally and which does not fall directly on the applicator.

According to one option, at least one air circulation vent (61; 62) is provided in the wiping device. By means of this, an air circulation circuit is provided between the interior of the container/bottle and the exterior, which makes it possible to avoid the piston effect when inserting the applicator or when removing the applicator.

Note that the skirt forming said drip edge improves the segregation between the air flow and the liquid flow, to avoid any splattering or passage of liquid through the air vent.

According to one option, the vent is arranged in the first part. As the first part is held rigidly in the neck, it undergoes little or no deformation and the vent remains open under all circumstances, even when the wiping sleeve undergoes major deformation.

Note that there is a gap between the tubular portion of the first part of the wiping device and the radially inner wall of the neck of the bottle, so as to allow the passage of air between the vent and the interior of the bottle.

According to one option, the vent is arranged in the wiping sleeve. By means of this, good passage of air between the interior of the bottle and the exterior is ensured even if the first part of the wiping device is hermetically pressed against the body of the bottle.

According to one option, the vent is formed as a hole with a vent axis, the vent axis being oriented in a radial direction (R) perpendicular to the main axis. In other words, the vent axis is horizontal. Undesirable dripping along the radially inner line can thus be avoided.

According to one option, the front end line (19) has a concavity with a downward curvature. This makes it possible to optimize the outward product-sweeping effect for the wiped product. According to one option, the concavity is an arc of a circle.

According to one option, the device may further comprise a reinforcing ring (5) at least around the lip. It is thus possible to use a material of high flexibility for at least the wiping lip and another material of good resilience for the reinforcing ring, the reinforcing ring providing less flexibility while remaining elastic; the reinforcing ring increases the durability of the wiping device. The reinforcing ring may provide a slight inward precompression.

According to one option, the reinforcing ring is housed behind the narrowest part of the wiping sleeve, meaning at least at the intermediate portion (13). This forms a natural housing to accommodate the reinforcing ring, with no need to provide another means of retention.

According to one option, at rest the acute angle (β) between the front end line and the radially inner line (LRI) is between 60° and 80°. The inventors have observed that this range is optimal in terms of scraping efficiency and mechanical strength of the lip. One will note that the acute angle β at the location of the scraping tip can decrease when a wiping force is applied, i.e. with a pressure directed radially outwards that is exerted by the applicator stem or the applicator head. According to one option, the device may be made of one material, meaning it is a single-material piece. Such a wiping device is therefore inexpensive to manufacture. The choice of material and its flexibility may depend on the type of wiping pressure targeted. The addition of said reinforcement/precompression ring is beneficial and complements the single-material wiping device to offer a simple, inexpensive, and particularly effective wiping device.

According to one option, the wiping device is dual-material, the first part forming a support being a first piece made of a first material and the second part forming a wiping sleeve being a second piece made of a second material, the second material being more flexible than the first material. This is an optimal use of the two materials, one rigid and the other flexible. The choice of materials can thus be optimized for rigid retention in the neck of the bottle on the one hand, and for flexibility of the wiping lip on the other hand.

According to one option, complementary overmolding shapes are provided. This makes it possible to obtain satisfactory cohesion between the first piece and the second piece.

According to one option, overmolding tabs are provided which are invisible from the upper side of the axial passage of the wiping sleeve. Once the wiping device has been inserted into the bottle, the technical elements of the overmolding are no longer visible.

According to one option, the radially inner line (LRI) is domed/convex.

According to another aspect, the invention relates to a wiping device for a product applicator, the device having an axis A and comprising:

a first part forming a support (1), a second part formed as a wiping sleeve (2), the wiping sleeve being suitable for wiping an applicator (3) stem immersed in a product to be dispensed by means of the applicator, the first part forming a support comprising an annular base configured to rest on a mouth of a product container (9), with an axial support flange and a tubular portion (14) centered on the axis A and intended to be mounted radially inside the mouth, the wiping sleeve (2) comprising a root portion (12) connected to the first part, a wiping lip (15), and an intermediate portion (13) interposed between the root portion (12) and the wiping lip (15), the wiping sleeve (2) comprising a central passage (20), wherein the wiping sleeve is generally a shape of revolution around the axis A with a half section which has the following profile at rest:

a radially inner line (LRI), which gradually approaches the axis as one moves away from the root portion (12), a scraping tip (P4), situated at the location closest to the axis of the wiping lip, a front end line (LAV), extending radially outwards from the scraping tip, a radially outer line (LRE), which gradually approaches the axis as one moves away from the root portion (12), doing so at least from the root portion (12) to the intermediate portion (13), a drip line (LEG) defining a drip edge (18), connected to the front end line and to the radially outer line, the half-section being such that its width E, measured perpendicularly to the axis, increases from the intermediate portion to the scraping tip (P4).

In addition, the angle (β) between the front end line and the radially inner line (LRI) may be between 60° and 110°.

BRIEF DESCRIPTION OF THE DRAWINGS

Other features, details, and advantages of the invention will become apparent upon reading the detailed description below, and upon analyzing the appended drawings.

DESCRIPTION OF THE PREFERRED EMBODIMENTS

In the various figures, the same references designate identical or similar elements. For clarity in the presentation, certain elements are not necessarily represented to scale.

Concerning the geometric positioning, direction A identifies the axis of the product, in particular the axis of the neck of the bottle (neck of the container). In addition, direction A identifies the axis of the wiping device and of the applicator stem. We can describe this axis A as 'main' or 'longitudinal'.

Container

Figure 2:
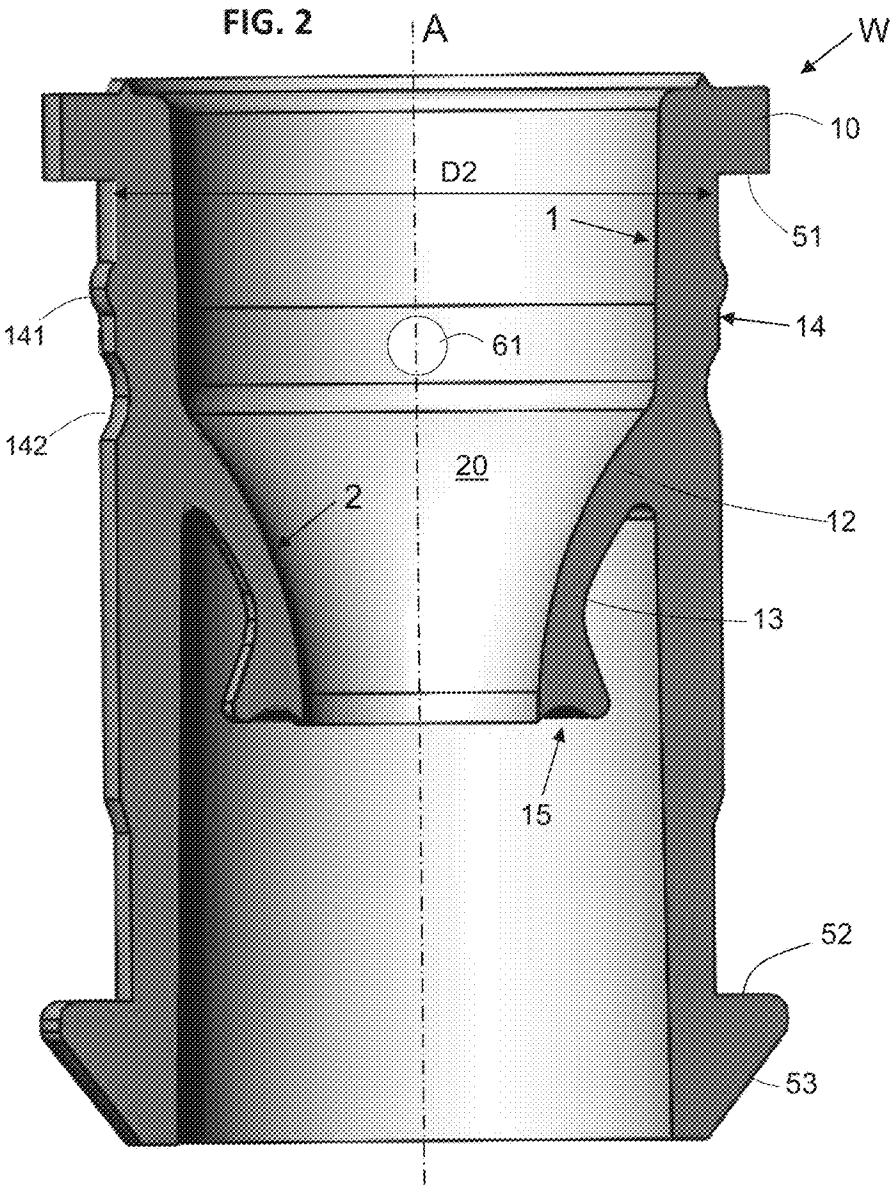
FIG. 2 illustrates a wiping device according to a first embodiment, in a perspective view in axial section.
Figure 1:
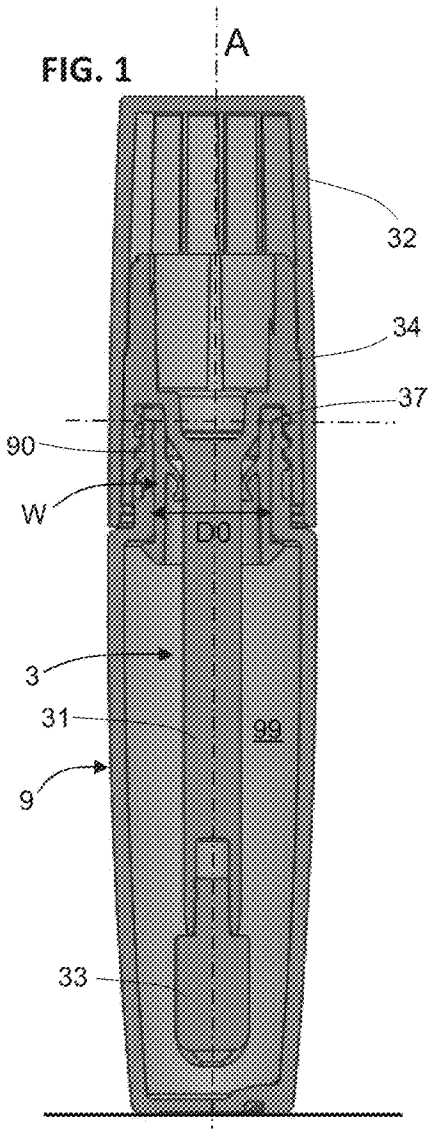
FIG. 1 illustrates a bottle of cosmetic product in axial section, with an applicator and a wiping device in accordance with an embodiment of the invention.

The packaging and application system represented in FIGS. 1 and 2 comprises a container 9 containing the product to be applied, for example a makeup product such as a foundation, a mascara, a lipstick, a nail polish, or generally any cosmetic product or cosmetic compound.

Instead of 'container', the terms 'bottle' or 'reservoir' may also be used to designate the recipient/container that encloses the cosmetic product, which may be liquid or pasty. Note that the liquid or pasty product could be other than a cosmetic product, for example a medicinal product, a decorative product, etc.

The container 9 may be made of glass or of a plastic synthetic material or thermoplastic material. This container 9 may be transparent or opaque.

The capacity of the container may typically be greater than 5 ml. In one particular range of applications, the capacity of the container may be between 20 ml and 100 ml. The interior space of the bottle is denoted 99.

According to the example illustrated, this container 9 is provided with a neck 90 in the upper part. The exterior of this neck is threaded. This neck comprises an upper edge delimited by the mounting plane (or seat) which the wiping device W fits onto, which will be discussed in detail below.

A radially inner wall of the neck, labeled 94, forms a receiving cylinder for the wiping device.

The inside diameter of the neck, denoted D0, is between 3 mm and 20 mm. Preferably, in particular for applicators with plastic stems, D0 will be between 9 mm and 12 mm for the typical applications targeted.

The applicator 3 comprises a stem 31 and an applicator head 33. The applicator 3 also comprises a part forming a cap suitable for screwing onto the threaded neck 90 mentioned above, as can be seen in FIG. 1. The part forming a cap may be produced in two parts, namely an aesthetic piece 32 visible from the exterior, and a technical piece 34 not visible from the exterior when the applicator 3 is installed on the bottle. However, producing the cap as one piece is not excluded.

The wiping device W comprises a first part forming a support 1, and a second part shaped as a wiping sleeve 2.

The wiping device may be manufactured as an integral piece, meaning one piece directly resulting from molding a single material. The wiping device may be manufactured as a dual-material piece, typically using a process of overmolding one material over another as will be seen below.

The wiping sleeve is suitable for wiping an applicator 3 immersed in a product to be dispensed by means of the applicator. Wiping is performed during withdrawal of the applicator by mechanical interaction, i.e. friction. Wiping is carried out successively on the stem 31 and on the applicator head 33.

The first part forming a support comprises a base with an annular flange 10 configured to rest on a mouth of the container 9.

A first axial support shoulder 51 and a tubular portion 14 centered on axis A and intended to be mounted radially inside the mouth 94 are provided.

The axial support shoulder 51, located under the flange 10, abuts against the upper end 37 of the mouth/neck of the bottle.

The annular base 10 may be retained in the neck 90 either by a tight fit of the tubular portion 14 when mounted, or by clipping in place.

The wiping sleeve 2 comprises a central passage 20, in other words an axial passage to allow the applicator to pass through and to wipe it during its passage by means of the wiping lip 15 which will be detailed below.

The wiping sleeve 2 comprises a root portion 12 connected to the first part 1, a wiping lip 15, and an intermediate portion 13. The intermediate portion 13 is interposed between the root portion 12 and the wiping lip 15.

The outer diameter of the tubular portion 14 of the first part 1 is denoted D2.

D2 is close to D0 or, at rest, slightly greater than diameter D0 at the mouth 94 so as to provide a force fit with slight compression.

Figure 3:
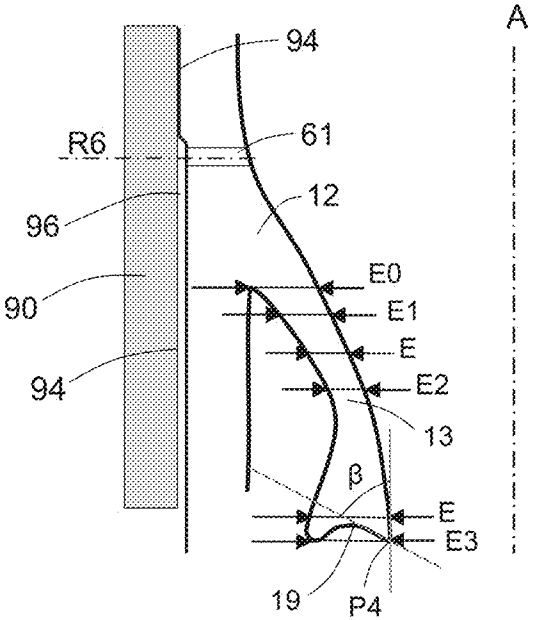
FIG. 3 schematically illustrates part of a wiping device, in axial half-section.

In a first embodiment of a wiping device that is a single-material piece, as illustrated in particular in FIGS. 2 and 3, an external shoulder 52 is provided in the lower part of the tubular portion 14. This shoulder comes to fit against the bottom of the mouth portion 90 of the bottle. One will note here that the harpoon shape given to the lower end 53 of the tubular portion makes it possible to insert the wiping device to a locking position from which it cannot be withdrawn. This is a clip-on assembly or snap-fit assembly.

In the example shown, the two shoulders 51,52 are arranged opposite one another, symmetrically relative to a plane transverse to axis A.

The wiping sleeve 2 is generally a shape of revolution around axis A. In other words, the half section of wiping sleeve and/or the wiping lip as discussed herein is the present disclosure is same and identical in every plan taken around the axis A, the shape is axisymmetric.

If we exclude the vents which will be discussed below, according to the first embodiment the wiping device is a shape of revolution around axis A.

The wiping sleeve 2 comprises, starting from the first part and gradually approaching axis A: a root portion 12 connected to the first part, an intermediate portion 13, a wiping lip 15. The wiping sleeve 2 has a generally frustoconical shape.

Figure 5:
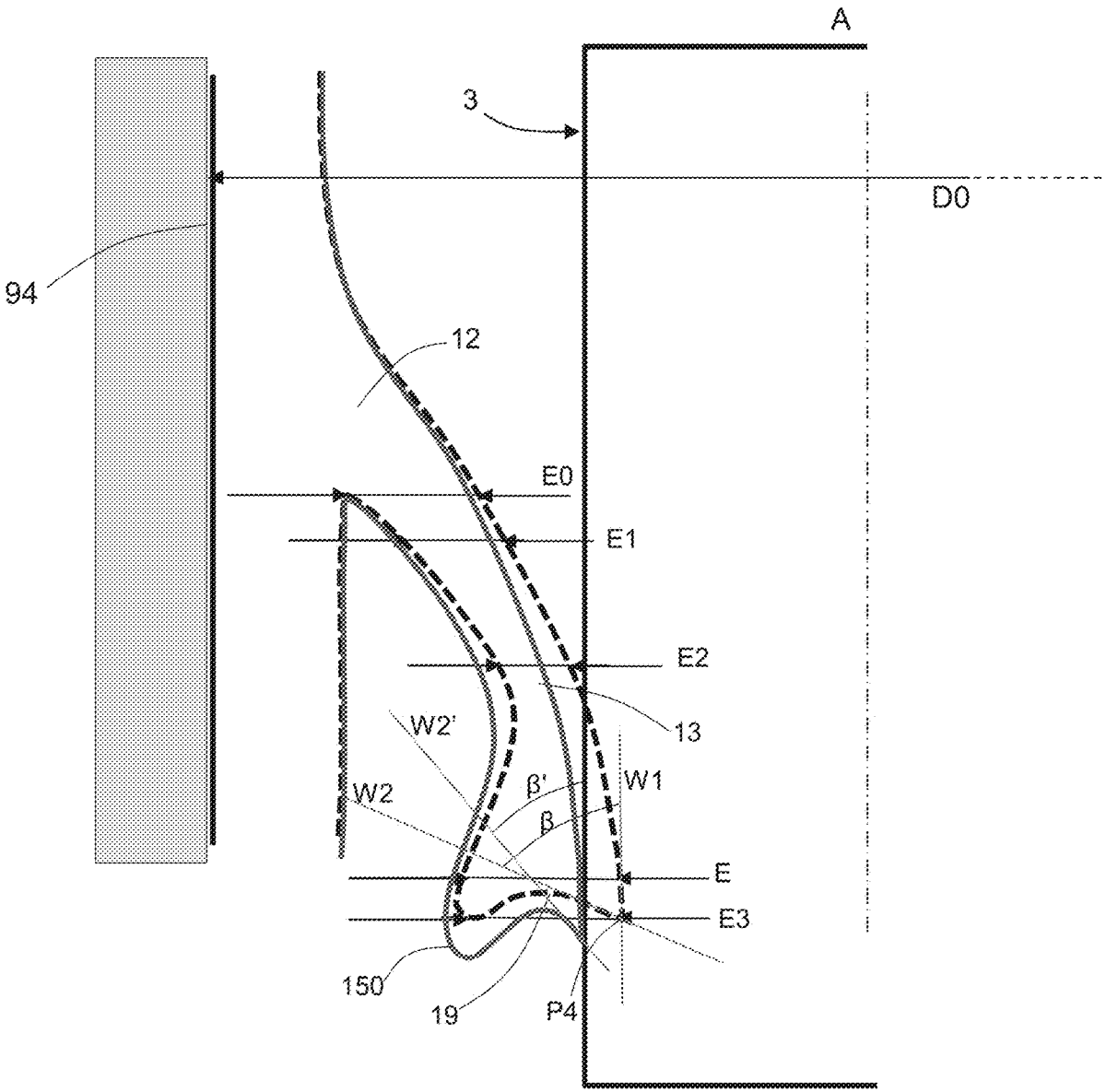
FIG. 5 schematically illustrates an example of deformation of the wiping sleeve, in axial half-section.

Note that the intermediate portion 13 is interposed between the root portion 12 and the wiping lip 15. During the wiping process, as illustrated in FIG. 5, the intermediate portion 13 expands, i.e. moves further away from the axis, and the wiping lip 15 expands, i.e. moves even further away from the axis.

Figure 4:
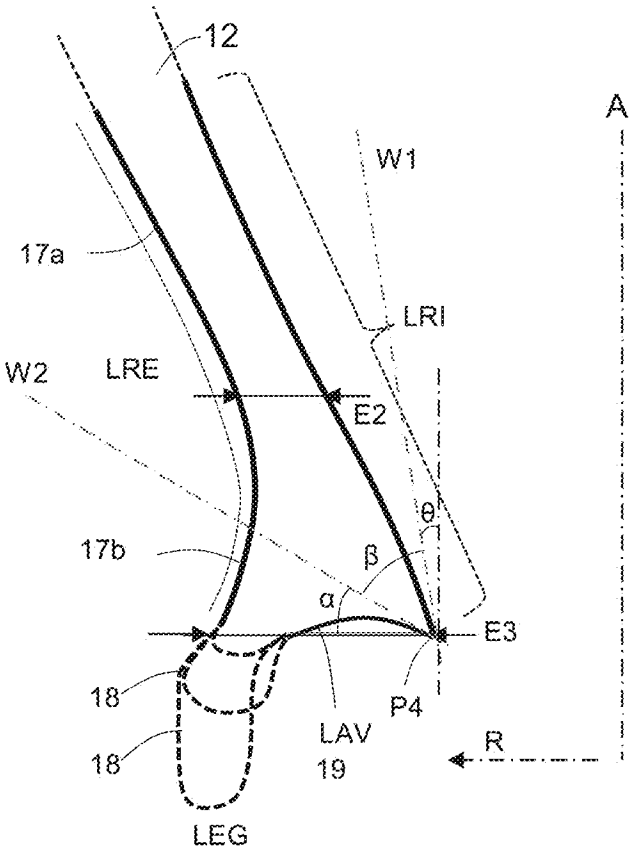
FIG. 4 schematically illustrates variants of the wiping device, in axial half-section.

As can be seen in FIG. 4 in particular, the wiping sleeve 2 has an axial half-section which has the following profile at rest:

a radially inner line LRI, which gradually approaches the axis as one moves away from the root portion 12, a scraping tip P4, situated at the location closest to the axis of the wiping lip at rest (in the absence of the stem and/or applicator), a front end line LAV, extending radially outwards from the scraping tip, a radially outer line LRE, which gradually approaches the axis as one moves away from the root portion 12, doing so at least from the root portion 12 to the intermediate portion 13, a drip line LEG defining a drip edge 18, connected to the front end line LAV and to the radially outer line.

In its simplest version, the drip line is formed as a front end 19, with a radially outer bead without a skirt.

In the illustrated example, such a front end line 19 has a concavity of downward curvature. This makes it possible to optimize the outward product-sweeping effect for the wiped product. The concavity is shaped as an arc of a circle or may be any other concave shape.

The half-section is such that, at the scraping tip, the radially inner line LRI forms, at rest, an angle denoted $\beta$ with the front end line LAV.

Generally, the angle $\beta$ is an acute angle, i.e. between 0° and 120°. More particularly, the angle $\beta$ may be an acute angle, i.e. between 0° and 90°. In practice, the angle $\beta$ may be selected within a range of between 30° and 90°. Preferably, the angle $\beta$ may be selected within a range of between 45° and 90°. According to a preferred option, at rest, the acute angle ($\beta$) between the front end line and the radially inner line LRI is between 60° and 80°.

W1 is the tangent to the profile of the scraper tip P4 half-section nearer the radially inner line LRI. W1 is inclined relative to the main axis A, at an angle denoted $\theta$ (see FIG. 4).

W2 is the tangent to the profile of the half-section scraper tip P4, nearer the front end line LAV. W2 is inclined relative to the main axis A, at an angle denoted $\alpha$ relative to a radial direction R, namely transverse/orthogonal to axis A.

Note that by construction, $\alpha+\beta+\theta=90°$.

Note that the radially inner line LRI is a convex curve viewed from the axis. Note that in other embodiments the radially inner line LRI is flat.

The radially outer line LRE gradually approaches the axis as one moves away from the root portion 12, this occurring in an upper portion 17*a* of the radially outer line LRE.

In addition, it may advantageously be provided that the radially outer line LRE gradually moves away from the axis as one moves away from the intermediate portion towards the front end line in a lower portion 17*b* of the radially outer line LRE.

The width E3 of the half-section, measured perpendicularly to the axis, is generically denoted E with an index k, i.e. Ek for certain specific measurements.

The half-section is such that its width E increases from the intermediate portion 13 to the scraping tip P4.

In other words, the width Ek is the distance which separates the radially inner line LRI from the radially outer line LRE in a direction perpendicular to axis A.

As illustrated in the first embodiment, the width E of the half-section may decrease from the root portion 12 to the intermediate portion 13.

In other words, starting from the root portion, the width E must first decrease and then increase to the scraping tip. This "waist" forms a flexible area and provides possibilities for insertion and withdrawal even with a slight misalignment. This improves the ease of use.

However, the width E of the half-section could be constant from the root portion 12 to the intermediate portion 13.

Under a clamping force induced by the presence of an applicator, the width E may slightly decrease due to the relative squeezing of the half-section profile as illustrated in FIG. 5. This reduction in width increases as one nears the scraping tip P4.

Note that all the points formed by the scraping tip P4 form a circle centered on axis A.

We denote E2 the minimum width measured at rest and at the intermediate portion 13, meaning the smallest width E along the profile is E2.

Advantageously, the width E3 of the half-section, measured at the scraping tip P4, relative to the minimum width E2 is such that $E3>1.3\times E2$.

Preferably it is also possible to choose $E3>1.4\times E2$. Specifically it is also possible to choose $E3>1.5\times E2$.

Furthermore, one can consider choosing $E3<2\times E2$ as the upper limit, or even $E3<1.75\times E2$.

At least one air circulation vent 61 is provided in the wiping device.

In the first embodiment, the vent 61 is arranged in the first part 1. A second vent 62 positioned diametrically opposite the first vent 61 may be provided.

In the example shown, the vent is formed as a hole with a vent axis R6, the vent axis being oriented in a radial direction R perpendicular to the main axis A.

In other words, the vent axis forms a radial hole oriented horizontally.

The position of the vent is fairly high, but an annular gap 96 is provided which places the radial hole in communication with the interior of the bottle 99.

As illustrated in FIG. 5, under a radial force directed outwards, produced by the presence of an applicator head or stem, the wiping lip 15 tends to deform outwards. In particular, tangential direction W1 tends to straighten vertically, for example along the stem, while tangential direction W2 also straightens (see position labeled W2'). Note that the angle β also decreases under an outwardly directed stress.

For the material of the single-material wiping device, an elastomeric polymer from the family of polyolefins or polyamides is chosen for example. In particular, one may choose TPE, TPA, TPV, TPE-a, etc.

In particular, a food-safe material is chosen.

Furthermore, the choice of material is made to minimize creep phenomena, because most of the time the stem is inserted into the wiping sleeve, and consequently the wiping lip is not at rest the vast majority of the time during the user utilization stage of life.

In the first embodiment, one will note a bead 141 which protrudes radially outwards all around the tubular portion 14. This bead is squeezed by force-fitting the wiping device into the neck of the bottle. This compressed mounting ensures that the wiping device is held in place.

Also provided is an annular shape that is slightly set back, namely a shallow groove 142 which allows ensuring that air can reach at least one vent 61, 62 even in the event of specific stresses or according to manufacturing tolerances and process variations.

Second Embodiment

Figure 7:
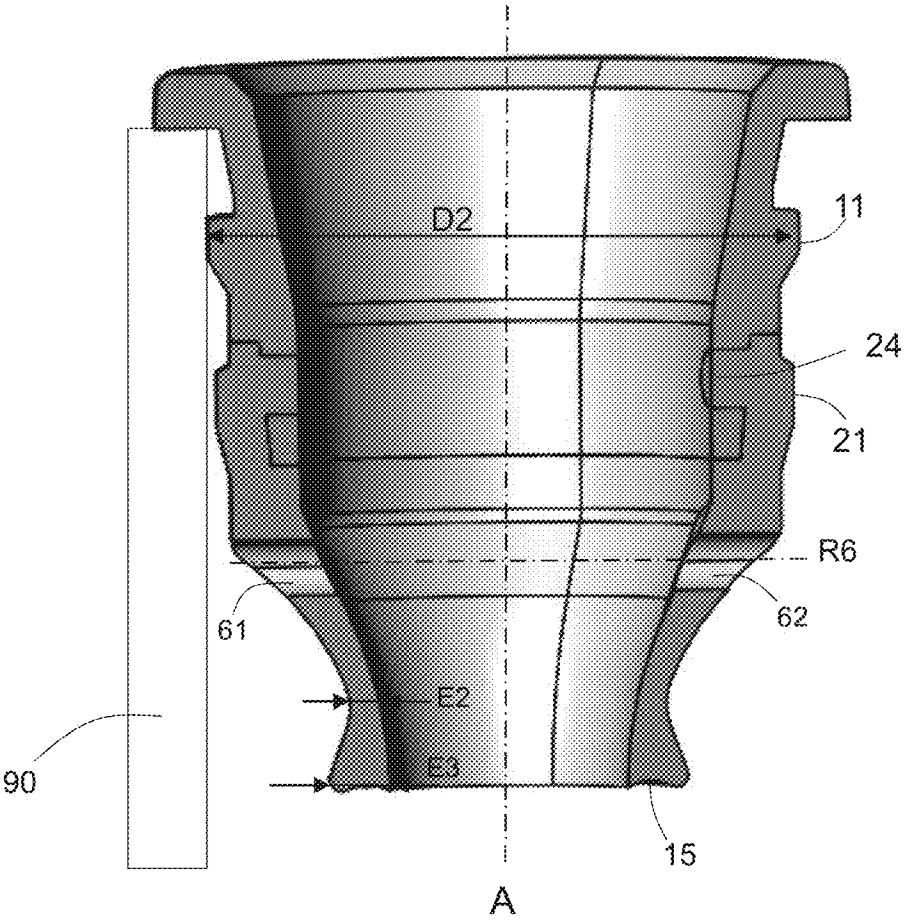
FIG. 7 illustrates a wiping device according to the second embodiment, in a perspective view in axial section.
Figure 6:
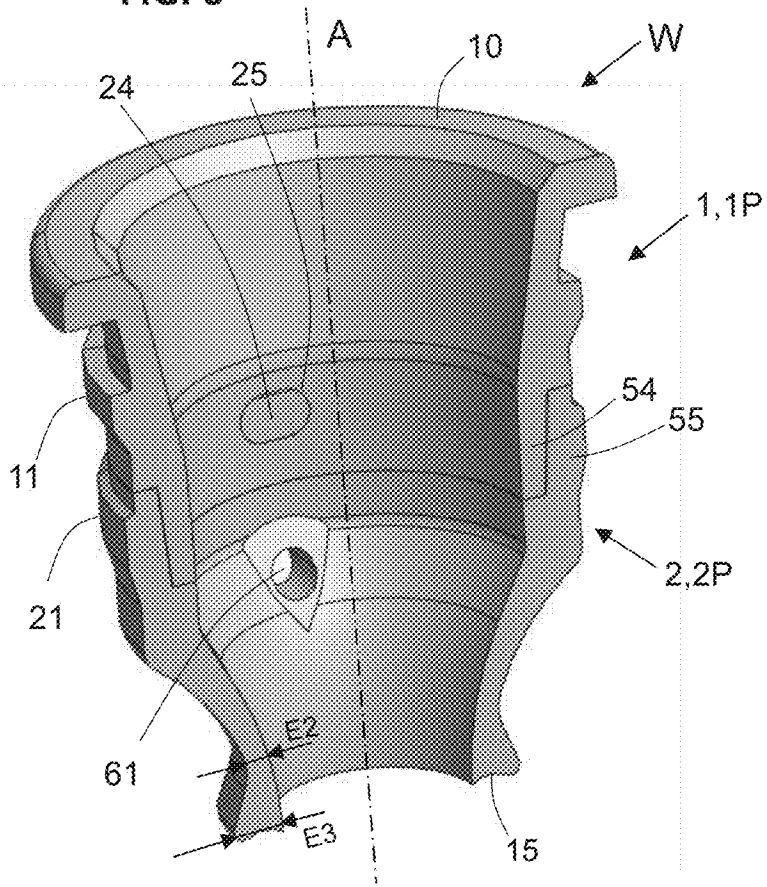
FIG. 6 schematically illustrates part of a wiping device according to a second embodiment manufactured in two pieces, in axial half-section.

In this second embodiment, illustrated in particular in FIGS. 6 and 7, the wiping device is dual-material: the first part 1 forming a support is a first piece 1P made of a first material and the second part forming a wiping sleeve is a second piece 2P made of a second material. Regarding the choice of materials, the second material is more flexible than the first material.

The rigidity of the first piece enables forceful insertion into the neck of the bottle and retention due to the bead 11 whose diameter D2 at rest is slightly greater than the inside diameter of the neck D0. Note that it is not excluded to have a bead provided in the second piece (denoted 21) that is also in tight contact with the inside diameter of the neck.

The wiping lip 15 is formed in the second piece 2P.

The geometry of the wiping lip 15 is in accordance with what has been described for the first embodiment. In particular, concerning the dimensions and in particular the transverse thickness of the wiping sleeve, notably the ratios E3 versus E, the values and ratios given for the first embodiment also apply here.

Note here that the two vents 61 62 are formed in the second piece 2P. Here too, their axis R6 is perpendicular to the main axis, in other words the vent holes are oriented horizontally in the normal position of use of the bottle and applicator.

Concerning the overmolding and the nesting between the first piece 1P and the second piece 2P, at an intermediate height of the final piece, the first piece comprises an inner tubular portion 54 intended to be covered by an outer tubular portion 55 coming from the second overmolded material. The overlap occurs over a height of a few millimeters, say between 3 and 10 millimeters.

In addition, two diametral studs 24 are provided which each come to be received in a corresponding hole 25 made in the first piece. The studs and corresponding holes 24,25 are located at the area of overlap between the inner tubular portion 54 and the outer tubular portion 55.

The radial thickness E of the wiping device at the overlap between the first piece and the second piece remains controlled, for example less than 3×E2 or even 2.5×E2, or even less than 1.5×E3.

During the overmolding operation, the fluid plastic second material becomes lodged inside the holes and cavities provided in the first piece, and after the material sets, the first piece can no longer be separated from the second piece due to the nesting of the complementary shapes.

Third Embodiment

Figure 9:
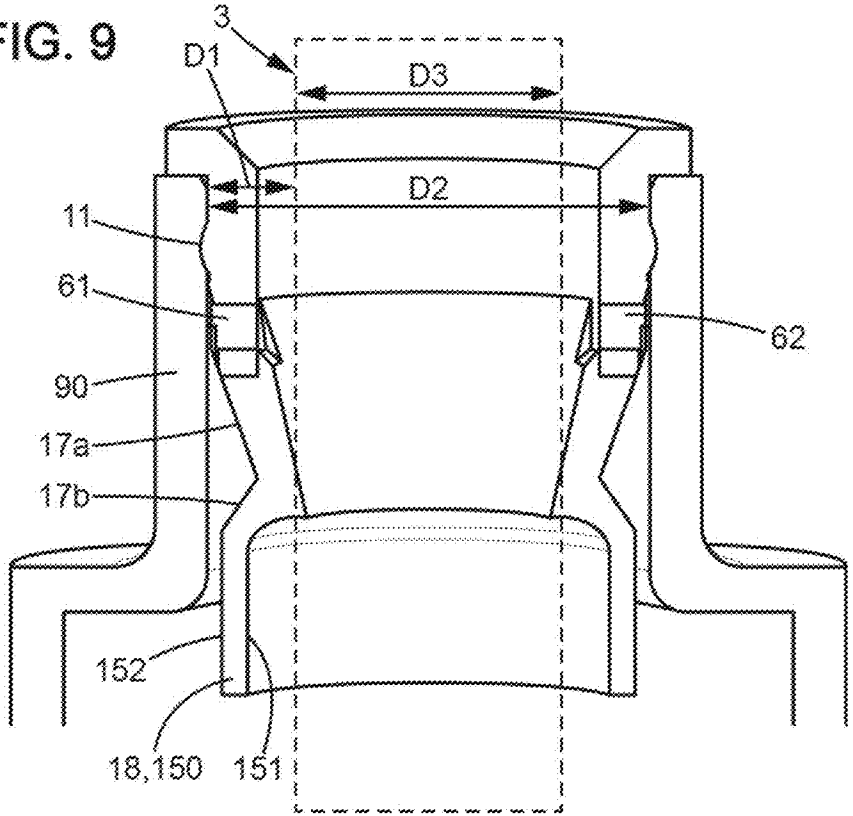
FIG. 9 illustrates a wiping device according to a third embodiment manufactured in two pieces, in a perspective view in axial section.
Figure 8:
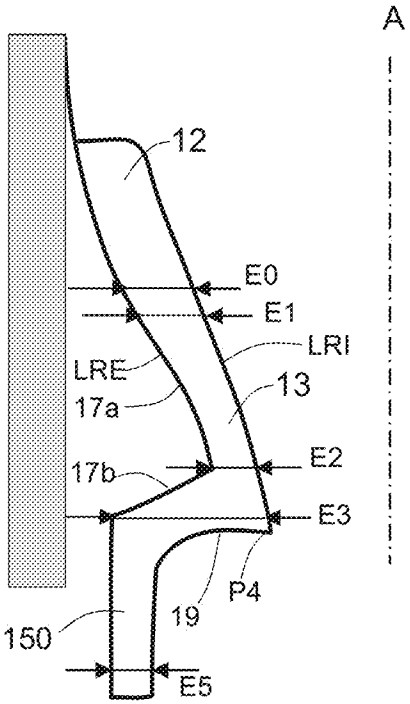
FIG. 8 schematically illustrates part of the wiping device variants with a skirt, in axial half-section.
Figure 10:
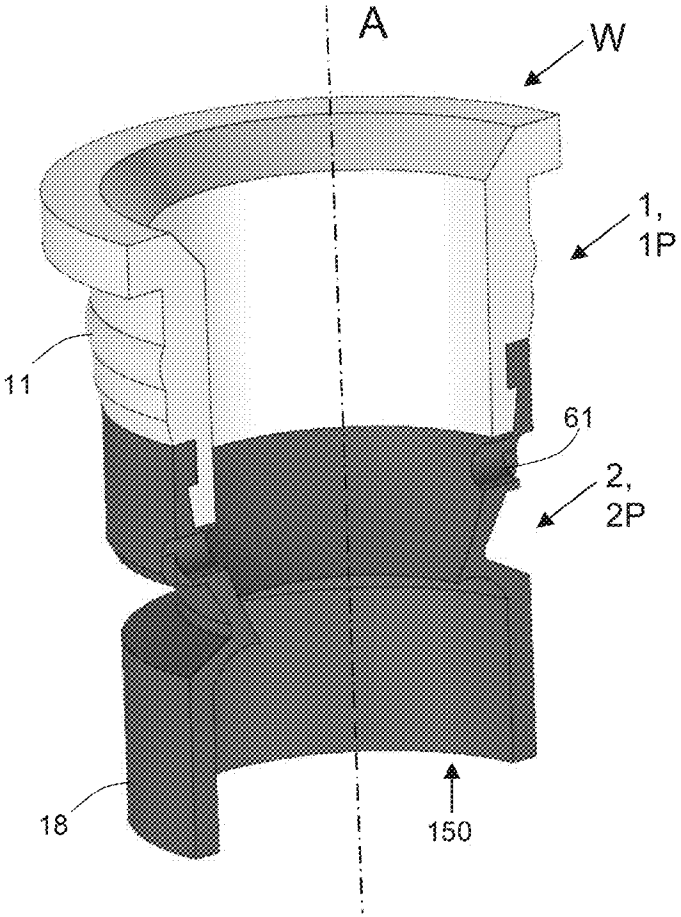
FIG. 10 schematically illustrates part of a wiping device according to the third embodiment, in axial half-section.

In a third embodiment illustrated in FIGS. 8, 9, and 10, the wiping device W is produced in two pieces, each having its own material and a specific flexibility. The principle of overmolding described in the second embodiment also applies to this third embodiment.

This third embodiment is distinguished by the presence of a skirt 150 which forms the drip edge 18. The skirt extends cylindrically downwards from the wiping lip, with a diameter greater than that prevailing at the scraper tip P4. The thickness E5 of the cylindrical skirt may be close to the minimum thickness E2 of the wiping sleeve.

Note, however, that the wiping sleeve, from the root portion 12 to the intermediate portion 13, is in accordance with the features set forth concerning the first embodiment.

As can be seen in FIG. 8, E3 may be approximately two times E2.

It should be noted that in FIG. 9, the dotted line represents the geometry of the stem 31 which has a transverse dimension wider than the available opening at rest at the scraping tip P4. Dimension D1 is characteristic of the space available between the stem and the neck of the bottle. In practice this is quite small, typically less than 3 mm. The diameter of the stem D3 is around 4 to 6 mm.

The entire function of the wiping sleeve must be contained within the annular gap of dimension D1 around the stem inside the neck of the bottle.

The considerations concerning dimensions D0, D1, D2, D3 are common to all embodiments presented in this document.

Figure 11:
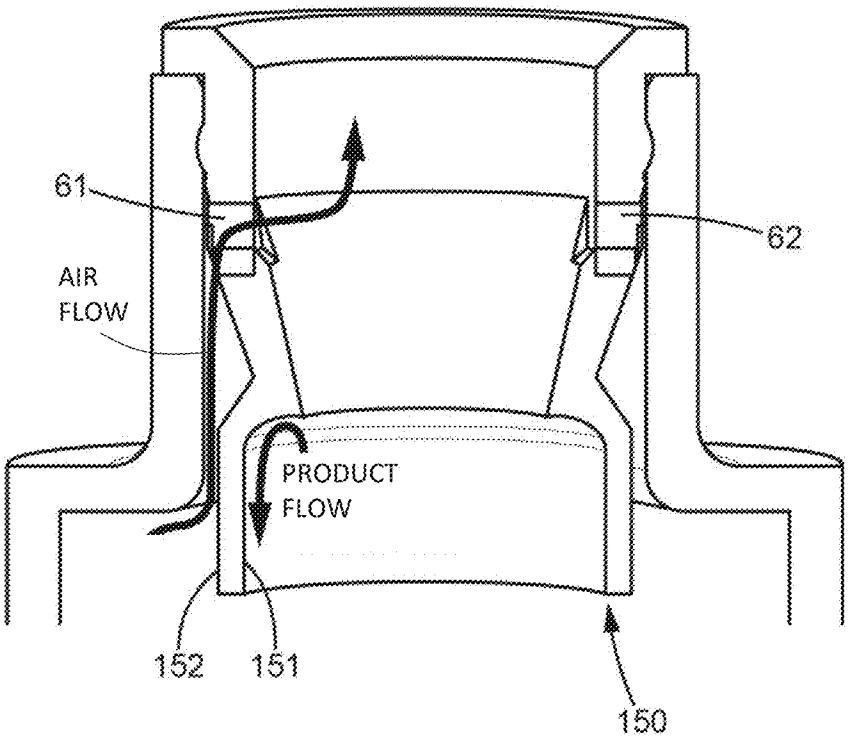
FIG. 11 illustrates the separate circulation of liquid and air at the wiping device

As illustrated in FIG. 11, management of the air flow and of the flow of wiped product can be improved by the presence of this skirt. The wiped product descends on the inner face 151 of the skirt, while air rises between the outer face 152 of the skirt and the neck of the bottle. The segregation between the liquid product and the air avoids any sputtering and splattering effect during the possibly rapid insertion and withdrawal of the applicator. In addition, this solution allows better performance when the bottle is no longer vertical but is substantially tilted. For example, even at a substantial angle, depending on the amount of product remaining in the bottle, the skirt 150 ensures good separation between the flow of air and the flow of product and makes it possible to avoid any splattering. Generally the skirt allows maintaining sufficient separation between the flow of air and the flow of liquid even when tilted or during shaking and/or dynamic movements.

Note that in this third embodiment, the radially inner line LRI is more or less straight.

Fourth Embodiment

Figure 13:
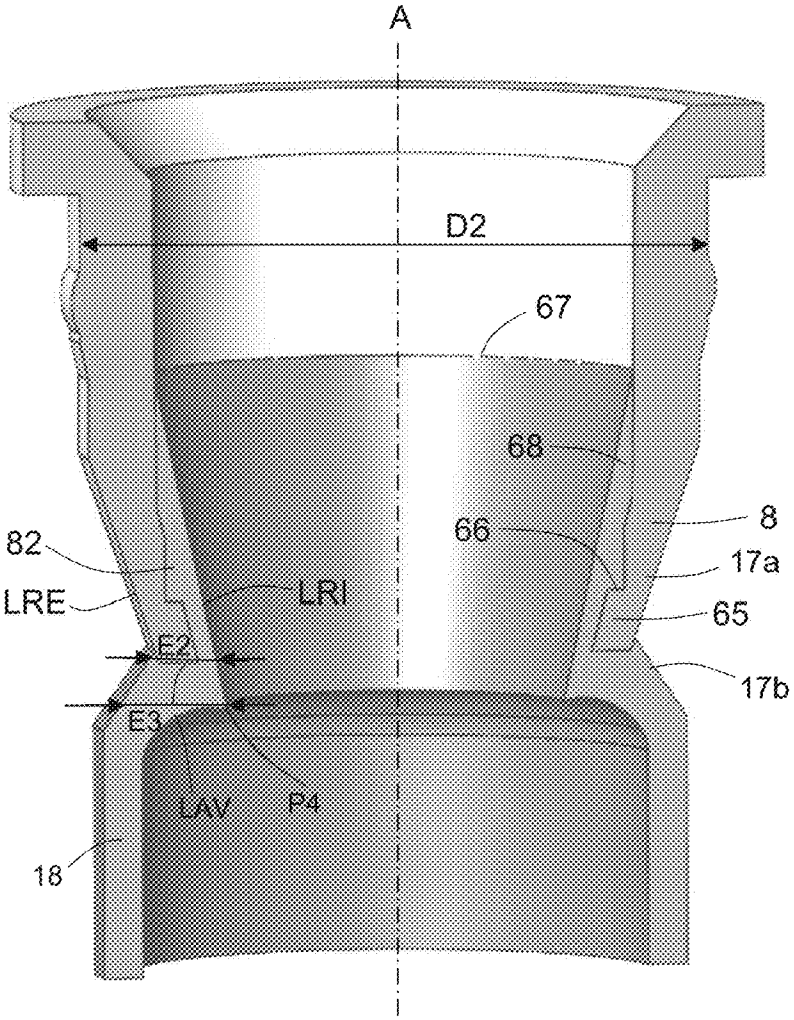
FIG. 13 illustrates a wiping device according to the fourth embodiment, in a perspective view in axial section.
Figure 12:
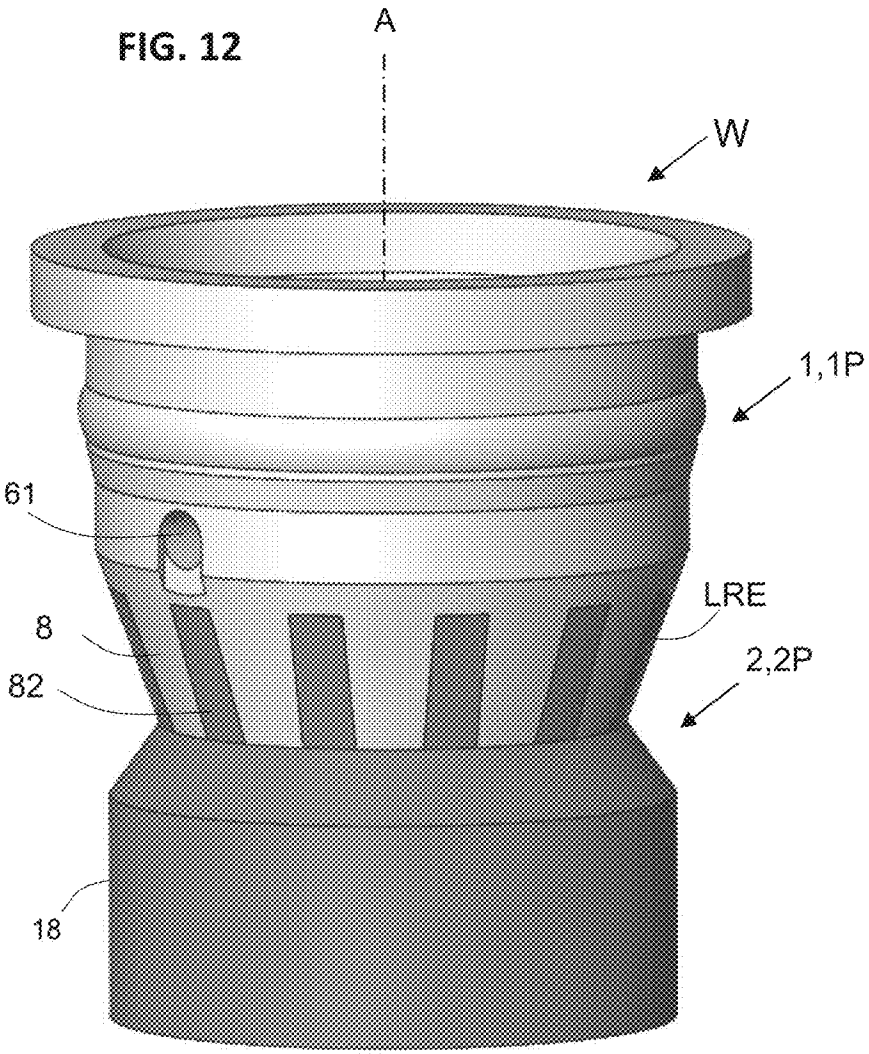
FIG. 12 illustrates a wiping device according to a fourth embodiment manufactured in two pieces, in a perspective view.
Figure 14:
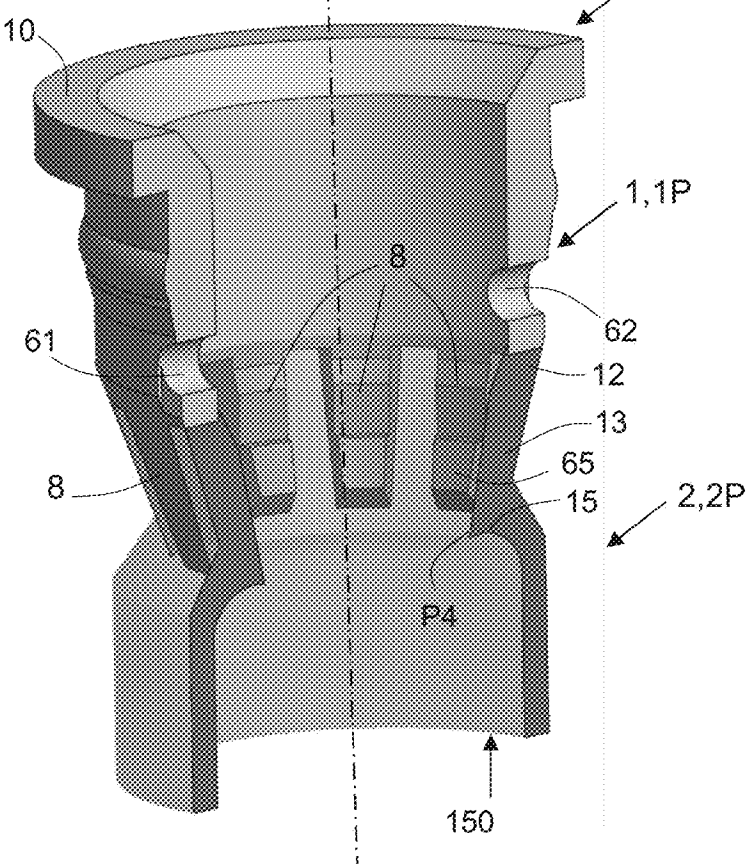
FIG. 14 illustrates a wiping device according to the fourth embodiment, in a perspective view in axial section.

In a fourth embodiment illustrated in FIGS. 12, 13, and 14, the wiping device W is produced in two pieces, each having its own material and a specific flexibility. The overmolding here makes use of a plurality of fingers 8 from the first piece 1 P. Along the circumferential direction, each pair of fingers 8 defines an empty space between these two fingers, intended to be filled with the second polymer material during overmolding.

Note that the fingers 8 follow the general conical orientation of the wiping sleeve. The fingers therefore extend downwards from the root portion 12. Each of the fingers ends in a protrusion 65 which forms a hook for the complementary part of the second material which will catch thereon at the interface (portion denoted 66 in FIG. 13).

During the overmolding operation, the fluid plastic material of the second material lodges inside the free spaces between the fingers 8. The material of the second material then forms fingers 82 extending upwards, complementary to the first fingers 8. In addition, formed by the second material is a conical ferrule 68 of small thickness which comes to fill the space left free inside, up to a level denoted 67.

The radially outer line LRE is defined by the descending fingers 8 of the first piece, while the radially inner line LRI is delimited by the upward fingers 82 of the second piece and the ferrule 68.

The overmolding fingers 8 are invisible from the upper side of the axial passage 20 of the wiping sleeve. Once the wiping device has been inserted into the bottle, the technical elements of the overmolding are no longer visible.

In this fourth embodiment, as can be seen in FIG. 13, the thickness E3 measured at the scraping tip is approximately 50% greater than the thickness E2 measured at the minimum cross-section, i.e. at the overmolding protrusions.

Fifth Embodiment

Figure 15:
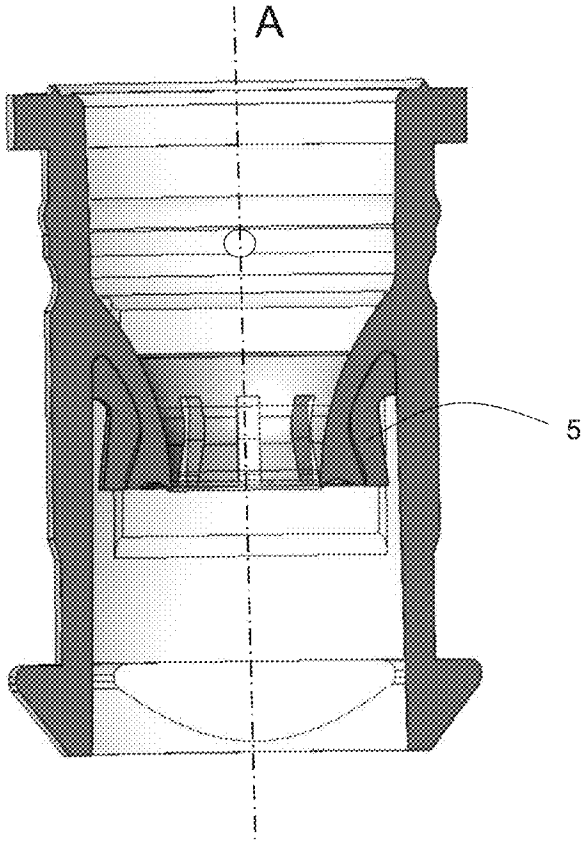
FIG. 15 illustrates a fifth embodiment in a perspective view in axial section.

According to a fifth embodiment, representing a variant of the first embodiment, illustrated in particular in FIG. 15, the device may further comprise a reinforcing ring 5 arranged behind the lip.

The reinforcing ring 5 may be a shape of revolution around axis A.

In the case illustrated, the reinforcing ring 5 is housed behind the narrowest part of the wiping sleeve, namely at least at the intermediate portion 13.

The reinforcing ring 5 supplements the single-material piece detailed above concerning the first embodiment.

The reinforcing ring 5 may be a metal ring, for example of stainless steel. The reinforcing ring may be a ring of polymer plastic.

Sixth Embodiment

Figure 16:
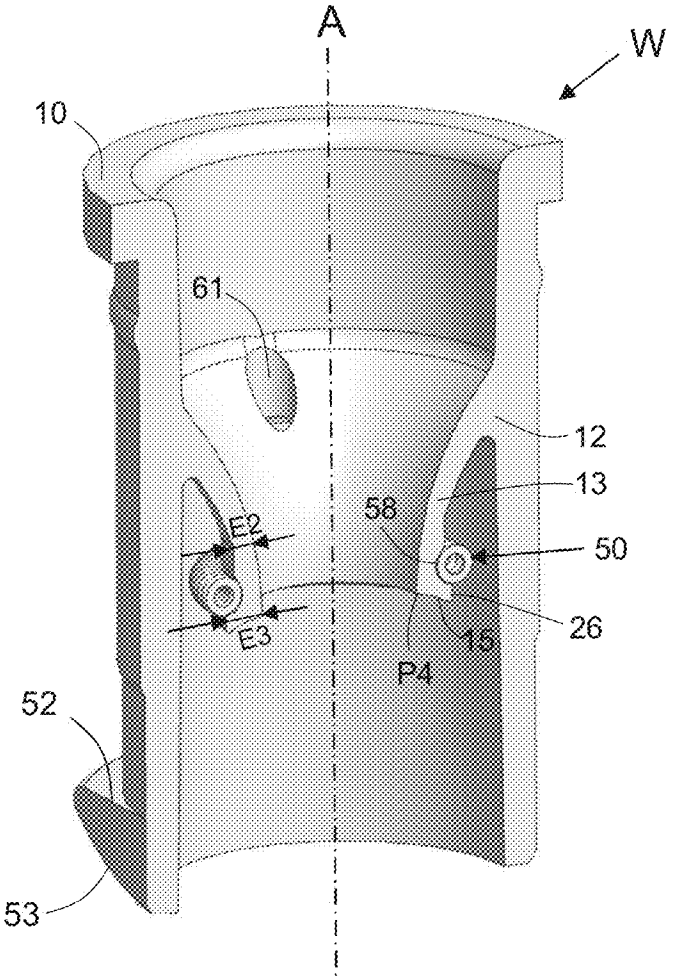
FIG. 16 illustrates a sixth embodiment in a perspective view in axial section.

According to a sixth embodiment, representing a variant of the first embodiment, illustrated in particular in FIG. 16, the device may further comprise a toroidal spring 50. A radially outer groove 58 is formed slightly above the wiping lip 15. This radially outer groove 58 is intended to receive the toroidal spring 50.

In the example shown, the toroidal spring 50 is a closed-loop coil spring and the toroidal spring 50 extends in a circle around axis A.

One will also note here that the width E3 of the half-section, measured perpendicularly to the axis at the scraping tip P4, relative to the minimum width E2 measured at the intermediate portion 13, is such that E3 >1.3 x E2.

The drip edge 18 is formed here by an outer tip 26.

In the example shown, the angle β between the front end line LAV and the radially inner line LRI is about 100° to 110°.

In general according to this sixth embodiment, the angle β between the front end line and the radially inner line LRI may be between 80° and 120°; it may preferably also be between 90° and 110°.

The material of the toroidal spring 50 may be stainless steel or a plastic material with good elasticity.

Other General Comments

Advantageously, the wiping lip 15 has a shape of revolution around axis A and extends circumferentially identically over 360°. This provides equilibrium and regularity in the wiping forces in the circumferential direction. There is no singular point that can generate a residual trace on the stem or disequilibrium in the material on the applicator head.

The invention claimed is:

1. A wiping device suitable for a product applicator, the device having an axis A and comprising:

a first part forming a support, a second part formed as a wiping sleeve, the wiping sleeve being suitable for wiping an applicator stem immersed in a product to be dispensed by means of the applicator, the first part forming a support comprising an annular base configured to rest on a mouth of a product container, with an axial support flange and a tubular portion centered on the axis A and intended to be mounted radially inside the mouth, the wiping sleeve comprising a root portion connected to the first part, a wiping lip, and an intermediate portion interposed between the root portion and the wiping lip, the wiping sleeve comprising a central passage, wherein the wiping sleeve is a shape of revolution around the axis A with a half-section which has the following profile at rest:

a radially inner line, which gradually approaches the axis as one moves away from the root portion, a scraping tip, situated at a location closest to an axis of the wiping lip, a front end line, extending radially outwards from the scraping tip, a radially outer line, which gradually approaches the axis as one moves away from the root portion, doing so at least from the root portion to the intermediate portion, a drip line defining a drip edge, connected to the front end line and to the radially outer line, the half-section being such that a half-section's width E, measured perpendicularly to the axis, increases from the intermediate portion to the scraping tip, the half-section being such that, at the scraping tip, the radially inner line forms an acute angle with the front end line.

2. The wiping device according to claim 1, wherein a width E3 of the half-section, measured perpendicularly to the axis at the scraping tip, relative to a minimum width E2 measured at the intermediate portion, is such that E3>1.3× E2.

3. The wiping device according to claim 1, wherein a width E of the half-section decreases from the root portion to the intermediate portion, thus forming a thinner intermediate portion.

4. The wiping device according to claim 1, wherein the drip edge forms a skirt extending as a distal ring directed downwards relative to the root portion.

5. The wiping device according to claim 1, wherein at least one air circulation vent is provided in the wiping device.

6. The wiping device according to claim 5, wherein the vent is arranged in the first part.

7. The wiping device according to claim 5, wherein the vent is formed as a hole with a vent axis, the vent axis being oriented in a radial direction perpendicular to the main axis.

8. The wiping device according to claim 1, wherein the front end line has a concavity with a downward curvature.

9. The wiping device according to claim 1, comprising a reinforcing ring at least around the lip.

10. The wiping device according to claim 1, wherein the acute angle between the front end line and the radially inner line is between 60° and 80°.

11. The wiping device according to claim 1, wherein the wiping device consists of one material.

12. The wiping device according to claim 1, wherein the wiping device comprises first and second materials, the first part forming the support being a first piece comprising the first material and the second part forming the wiping sleeve being a second piece comprising the second material, the second material being more flexible than the first material.

13. The wiping device according to claim 12, wherein complementary overmolding shapes are provided.

14. The wiping device according to claim 12, wherein overmolding fingers are provided which are invisible from an upper side of the axial passage of the wiping sleeve.

15. The wiping device according to claim 1, wherein a width E3 of the half-section, measured perpendicularly to the axis at the scraping tip, relative to a minimum width E2 measured at the intermediate portion, is such that E3>1.4× E2.

16. The wiping device according to claim 1, wherein a width E3 of the half-section, measured perpendicularly to the axis at the scraping tip, relative to a minimum width E2 measured at the intermediate portion, is such that E3>1.5× E2.

* * * * *